United States Patent [19]

Clavel

[11] 4,348,121

[45] Sep. 7, 1982

[54] STRIKE AND NON-STRIKE IMPACT CONTROL MECHANISM FOR TYPEWRITER

[75] Inventor: Raymond Clavel, Yverdon (Vaud), Switzerland

[73] Assignee: Hermes Precisa International S.A., Yverdon, Switzerland

[21] Appl. No.: 166,978

[22] PCT Filed: Feb. 6, 1979

[86] PCT No.: PCT/CH79/00016

§ 371 Date: Oct. 7, 1979

§ 102(e) Date: Jul. 19, 1979

[87] PCT Pub. No.: WO79/00598

PCT Pub. Date: Aug. 23, 1979

[30] Foreign Application Priority Data

Feb. 7, 1978 [CH] Switzerland ..... 1325/78

[51] Int. Cl.[3] ..... B41J 1/32

[52] U.S. Cl. ..... 400/166; 400/8; 400/161

[58] Field of Search ..... 400/161, 166, 8

[56] References Cited

U.S. PATENT DOCUMENTS

| | | | |
|---|---|---|---|
| 3,239,049 | 3/1966 | Voit | 400/166 |
| 3,618,736 | 11/1971 | Abell et al. | 400/166 |
| 3,788,443 | 1/1974 | Menzi | 400/166 |
| 3,980,169 | 9/1976 | Decker et al. | 400/166 |

FOREIGN PATENT DOCUMENTS

| | | | |
|---|---|---|---|
| 2336945 | 2/1974 | Fed. Rep. of Germany | 400/166 |
| 2701185 | 11/1977 | Fed. Rep. of Germany . | |
| 1360656 | 3/1964 | France . | |
| 1187507 | 4/1970 | United Kingdom . | |

OTHER PUBLICATIONS

IBM Technical Disclosure Bulletin, "Print Velocity Control Device", Abell et al., vol. 12, No. 7, Dec. 1969, p. 1032.

*Primary Examiner*—Ernest T. Wright, Jr.
*Attorney, Agent, or Firm*—Emory L. Groff, Jr.

[57] ABSTRACT

A strike and non-strike impact control mechanism for typewriter comprises a drive shaft (4) equipped with at least two cams (8 and 9) corresponding to different strike forces, a tracker (13) of the contour of said cams, the movement of which is transmitted to a printing element (1), means (17 and 18) for displacement of said tracker (13), and means (20, 40 and 41) for receiving command impulses. So as to avoid the transfer of significant amounts of energy in the course of giving command impulses the mechanism comprises a tension spring (39) which acts upon the displacement means (17 and 18) so as to cause them to work in connection with an abutment apparatus (34–38). Said abutment apparatus (34–38) is controlled in various positions by said reception means (20, 40 and 41). A return apparatus (59 and 61) driven by drive shaft (4) returns displacement means (17 and 18) to a position known as normal following each complete rotation of said shaft (4).

6 Claims, 8 Drawing Figures

Fig. 6
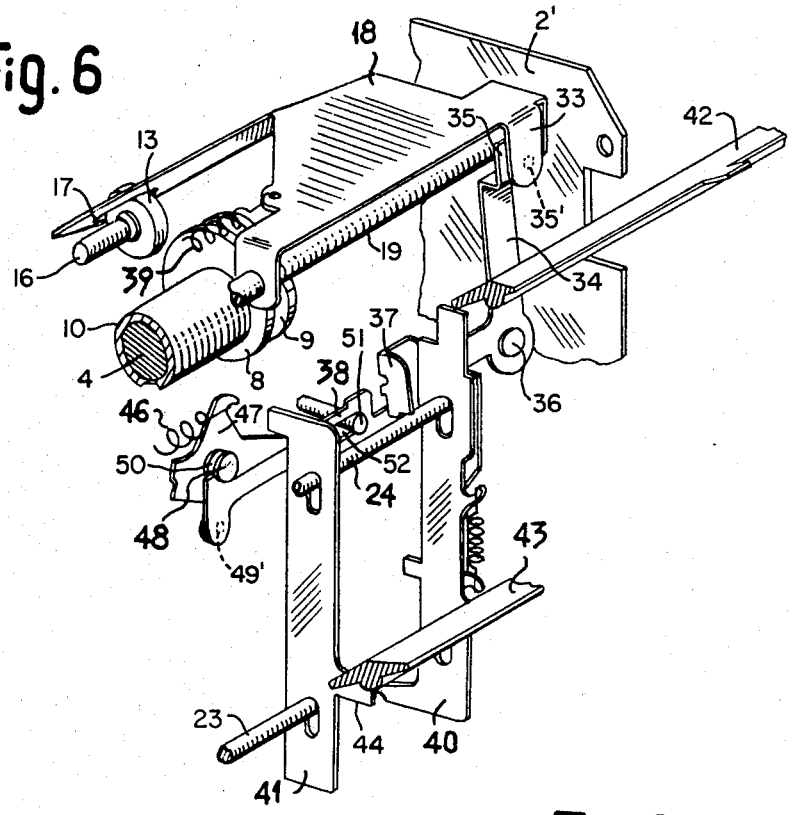
Fig. 8
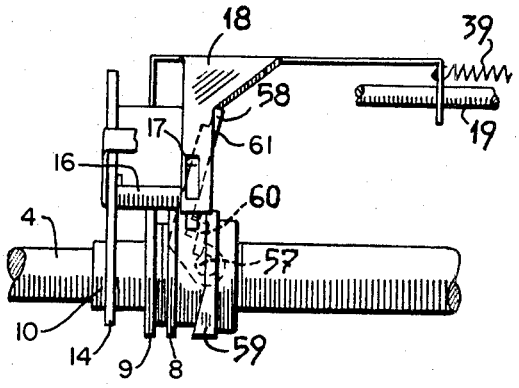
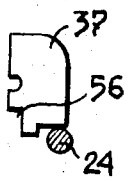
Fig. 7

STRIKE AND NON-STRIKE IMPACT CONTROL MECHANISM FOR TYPEWRITER

The present invention concerns a strike and non-strike impact control mechanism for a typewriter having a printing element which moves parallel to the platen on a carrier.

In a known mechanism of this type, the carrier comprises notably a drive shaft, two integral cams in rotation around the drive shaft and corresponding to different strike forces, means for displacement of a tracker of the radial contour of the cams designed to cause said tracker to work in connection with one or the other or neither of the cams, means for transmission of the movement of the tracker to the printing element, to assure the striking of a character in particular, and means for receiving control signals given by universal bars arranged parallel to the platen.

In known machines, means for displacement of the tracker are held in their normal position by the action of a spring. Upon the striking of a character requiring a different strike force, particularly a weaker one, universal bars transmit a command impulse and said reception means drive the tracker displacement means into another position in opposition to the force of the spring. During a strike, the position of the reception means is maintained by known blocking apparatus. Following a strike, the means for receiving command impulses are freed and the tracker displacement means return to their normal position by the action of the spring.

Such a mechanism requires a relatively high transfer of mechanical energy within the machine's command components, particularly within the universal bars and strike impulse reception means.

In fact, the control components must transmit sufficient force to compress the return spring and overcome the inertial forces of the parts set in motion.

Furthermore, the amplitude of the command impulses must be quite precise in order for the reception means blocking apparatus to work in connection with them.

In order for such a mechanism to be reliable under these conditions, it is necessary to provide sturdy command components and command impulse amplitude adjustment devices, as well as an apparatus for compensation of component deformation, all of which have the effect of increasing still further the inertial forces of the mechanism, as well as its cost.

The purpose of the present invention is to eliminate these drawbacks and to limit the forces transmitted by the command components in the transmission of an impulse.

The mechanism according to the invention is characterized in that it comprises an abutment apparatus, means for displacement of the tracker into several positions, activation of which is controlled by command impulse reception means, a pressurized spring acting upon the tracker displacement means so as to cause them to work together with said abutment apparatus, and apparatus for returning displacement means to their initial position, said apparatus being driven by the active drive shaft upon each complete rotation of said shaft.

The attached drawing shows schematically and by way of example one form of execution of the mechanism subject of the invention.

FIGS. 3 and 6 show the same mechanism in two other positions.

FIGS. 4 and 7 show a detail of FIGS. 3 and 6.

FIGS. 5 and 8 are elevation views of one part of the control mechanism in two positions corresponding to those illustrated in FIGS. 3 and 6.

Since typewriters with a printing element which moves parallel to the platen on a carrier are well known in the art, only those components indispensable to an understanding of the invention will be illustrated and described in the following.

Figure 1:
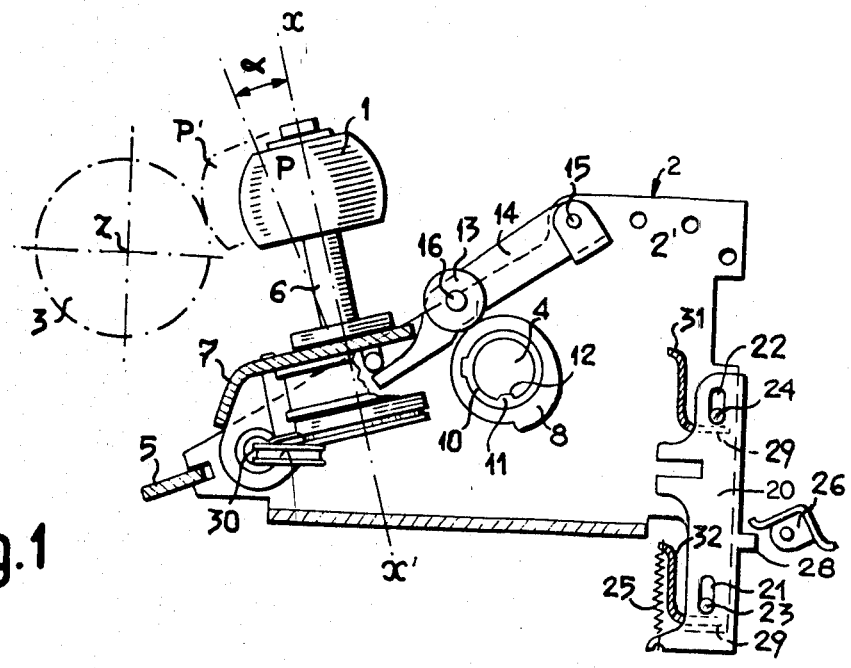
FIG. 1 is a cutaway section of the tracker of the machine showing the strike mechanism.

Referring first to FIG. 1, a printing element 1 is integral with a carrier 2 including two lateral walls 2' only one of which is shown, activated by a movement of translation parallel to axis Z of a platen 3. During said movement of translation, the carrier 2 slides along a drive shaft 4 rotatable at its two extremes upon the body of the machine (not shown) and along a bar 5 affixed to said body.

The printing element 1 is supported by a shaft 6 affixed to an oscillatable support 7. The latter is mounted between the two lateral walls 2' (only one of which is shown) of carrier 2 so as to be able to oscillate around an axis 30 parallel to axis Z of platen 3.

Drive shaft 4 powers the rotation of two cams 8 and 9 (FIG. 3) affixed to a mounted sleeve 10 rotatable between the two lateral walls 2' of carrier 2. Said sleeve 10 includes a projection 11 engaged within a channel 12 of drive shaft 4.

A roller 13 mounted upon a lever 14 which pivots around point 15 works in connection with the contour of cam 8 to impart a striking movement to the printing element 1 upon each complete rotation of the drive shaft 4. When roller 13 passes over the crest of cam 8, lever 14 pivots and causes oscillatable support 7 to move in such a way that, from initial position P, the printing element 1 moves to position P' and strikes platen 3. The printing element 1 is then returned to initial position P by means of a spring (not shown). The line X–X' designates the axis of printing element 1 in its initial position P whereas $\alpha$ represents the angle of displacement of printing element 1 when it is moved into its platen striking position P'.

The carrier 2 includes a first intermediate coupler 20 having two oblong openings 21 and 22, in which are engaged two shafts 23 and 24 affixed to the lateral walls 2' of carrier 2. Displacements of the printing element 1 for selection of the character to be struck are controlled by the coupler 20.

Intermediate coupler 20 may slide transversely to said shafts 23 and 24 against a return spring 25 under the effect of a command impulse given by a universal bar 26 acting on projection 28 of coupler 20. Coupler 20 is engaged in two slots 29 in two cross-pieces 31 and 32 affixed to the lateral walls 2' of carrier 2, so that it is guided by said slots 29 when moving.

Figure 5:
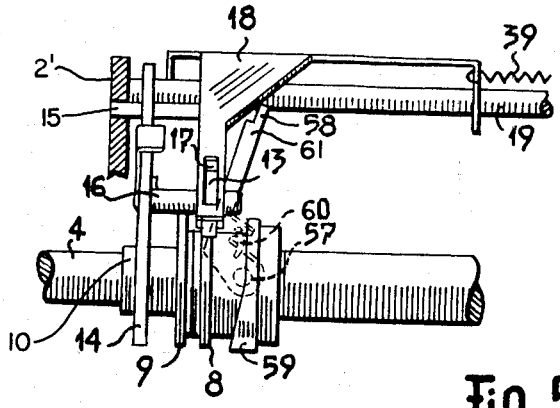

Roller 13 is mounted on lever 14 by means of a pivot 16 and, as shown in FIG. 5, is engaged in slot 17 of a carriage 18 which slides along shaft 19 parallel to axis Z of platen 3.

Depending on the position of carriage 18, the roller 13 may occupy three positions. It may work in connection with cam 9, causing a normal strike, or with cam 8, causing a weaker strike, or it may be located alongside cam 8 where, without a cam, no strike is produced.

Figure 2:
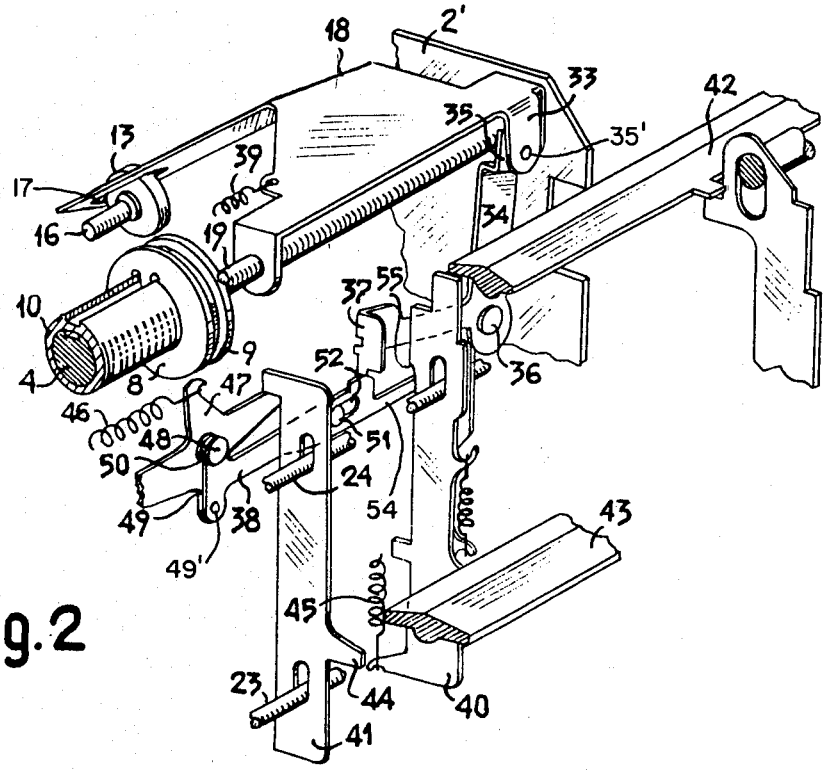
FIG. 2 represents in perspective the strike force control mechanism in its initial position.

As shown in FIG. 2, carriage 18 comprises a tongue 33 upon which is hinged the extremity 35 of lever 34 in a pivotable manner by a rivet 35'. The lever 34 swivels on a stud 36 affixed to cross-piece 31.

The other extremity 37 of lever 34 is bent back in order to be able to work in connection with a key 38 under the effect of a tensed pull spring 39 acting on carriage 18.

Second and third intermediate couplers 40 and 41 are engaged in the same manner as coupler 20 upon shafts 23 and 24, and may likewise slide transversely to said shafts 23 and 24 under the effect of a command impulse given by universal bars 42 and 43 respectively. Universal bar 42 acts upon the upper part of coupler 40 and universal bar 43 acts upon projection 44 of coupler 41.

Second and third intermediate couplers 40 and 41 are held in rest position at the top by (respectively) spring 45 and spring 46 acting upon coupler 41 by means of lever 47 which swivels on stud 48 affixed to cross-piece 31.

Key 38 is hinged to arm 49 of lever 47 in a pivotal manner by a rivet 49' and is engaged within a groove 50 in stud 48 in such a way that when lever 47 pivots, key 38 undergoes (in particular) a translation guided by a rod 51 which is integral with cross-piece 31 and engaged in oblong opening 52 of key 38.

Figure 3:
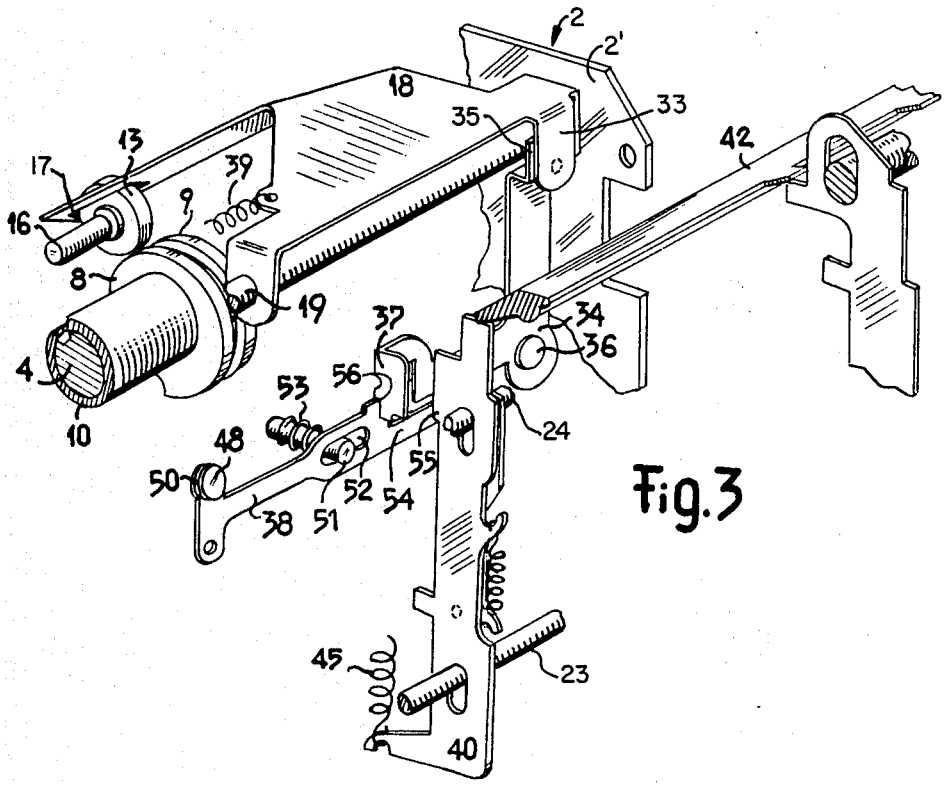

A spring 53 seen in FIG. 3 holds a prolongation 54 of key 38 against second intermediate coupler 40.

Figure 4:
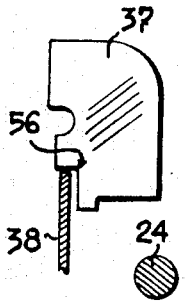

In the position illustrated in FIG. 2, extremity 37 of lever 34 butts against key 38 to maintain roller 13 in contact with cam 9. To change to a weaker strike, a swivelling action of universal bar 42 causes second intermediate coupler 40 to drop, against the force of spring 45. In this movement, ramp 55 on second intermediate coupler 40, working in connection with entremity 54 of key 38, pushes the latter in opposition to the force of spring 53, which frees extremity 37 of lever 34. Under the effect of spring 39, carriage 18 slides along shaft 19 and lever 34 swivels on stud 36 until a protrusion 56 in extremity 37 of lever 34 butts against key 38. In this position, represented in FIGS. 3, 4 and 5, roller 13 works in connection with cam 8.

FIGS. 6, 7 and 8 illustrate the case in which roller 13 does not work in connection with either cams 8 or 9 and where there is therefore no strike produced by the complete rotation of drive shaft 4.

To reach this position, a swivelling of universal bar 43 causes third intermediate coupler 41 to drop, in opposition to the force of spring 46. Upon this movement, key 38 moves in the direction of lever 47, freeing extremity 37 of lever 34. Under the effect of spring 39, carriage 18 slides along shaft 19 and causes lever 34 to swivel until extremity 37 of said lever 34 butts against shaft 24, as illustrated in FIG. 7.

In this arrangement, the forces to be transmitted by universal bars 42 and 43 are very low, since movement of the carriage 18 is assured by tension spring 39. Return from the positions illustrated in FIGS. 3 and 6 to the normal strike position (illustrated in FIG. 2) is ensured by a return apparatus powered by drive shaft 4.

This apparatus is illustrated in FIG. 8 and comprises a lever 61 swivelling at one extremity around a fixed stud 57 which is carried by carrier 2 and is able to work in connection with carriage 18 at its other extremity 58. A rotatable axial cam 59 integral with drive shaft 4 works in connection with a bend 60 provided in the middle section of lever 61. The contour of the axial cam 59 is designed so that following each complete rotation of drive shaft 4 it will return carriage 18 from any position to its normal position (illustrated in FIG. 2) after a rotation phase corresponding to the striking of a character. Thus, in the course of a low-force strike, lever 61, in connection with cam 59, returns carriage 18 to its normal position (in opposition to the force of spring 39) from the position illustrated in FIG. 3, in which it had been placed in the preceeding manner, upon the completion of a strike.

In the mechanism described, the energy necessary for displacement of carriage 18 is provided by drive shaft 4 and stored in spring 39 until a reduced-strike or non-strike order is given by universal bars 42 and 43.

I claim:

1. Strike and non-strike impact control mechanism for a typewriter having a printing element (1) movable parallel to a platen (3) upon a carrier (2), said mechanism comprising particularly a drive shaft (4), at least two rotatable cams (8 and 9) integral with the drive shaft and corresponding to different strike forces, a guidance component (17 and 18) for guiding a tracker (13) of the radial contour of said cams (8 and 9), and capable of displacing said tracker so as to cause said tracker to work in connection with one or the other or neither of said cams, means (14-17) for transmission of the movement of said tracker (13) to said printing element (1) to assure particularly the striking of a character, and means (20,40 and 41) for receiving command impulses given by universal bars (26,42 and 43) arranged parallel to said platen (3), characterized in that said control mechanism comprises abutment apparatus (34-38) for abutting said guidance component (17 and 18) of said tracker (13) in several positions, the activation of said apparatus being controlled by said means (20,40 and 41) for receiving command impulses, a tension spring (39) acting upon said guidance component (17 and 18) of said tracker (13) to cause said means for receiving command impulses to work in connection with said abutment apparatus, a return apparatus (61 and 59) for return of said guidance component into a normal position, said return apparatus being driven by said drive shaft (4) upon each complete rotation of said drive shaft, said means for receiving command impluses comprising first, second and third intermediate couplers (20,40 and 41), said abutment apparatus comprising a key (38), the position of which is controlled by said second and third intermediate couplers (40 and 41) for receiving command impulses, and by an extremity (37) of a lever (34) driven by said guidance component (17 and 18) of said tracker (13), and set up so as to work in connection with said key (38) in several positions corresponding to the choice of strike or non-strike force.

2. Mechanism according to claim 1, characterized in that said return apparatus comprises a return cam (59) integral with said drive shaft (4) and a lever (61) which rotates on a fixed axis (57) upon said carrier (2) and works, on the one hand, with said guidance component (17 and 18) of said tracker (13) and, on the other hand, with the contour of said return cam (59).

3. Mechanism according to claim 2, characterized in that said lever (61) comprises, in its middle section, a bend (60) capable of working in connection with said return cam (59) having an axial contour, said lever (61) rotating at one of its extremities around an axis (57) which is substantially orthogonal to the direction of displacement of said carrier (2), its other extremity (58) being capable of working in connection with said guidance component (17 and 18).

4. Mechanism according to claim 1, characterized by a compression spring (53) acting upon said key (38) so as to keep one of its elongated extremities (54) in contact with said second intermediate coupler (40), a ramp (55) on said second intermediate coupler and capable of working in connection with said one elongated extremity (54) of said key (38) in opposition to the force of said compression spring (53) when a low-force impulse is given.

5. Mechanism according to claim 4 characterized, in that said extremity (37) of said lever (34) driven by said guidance component comprises a protrusion (56) working in connection with said key (38) when a reduced-force strike impulse is given.

6. Mechanism according to claim 1, characterized in that said key (38) is hinged upon a lever (47) working in connection with said third intermediate coupler (41) and comprises an oblong opening (52) in which is engaged a rod (51) affixed to said carrier (2) in such a way that when a non-strike impulse is given, said key (38) undergoes particularly a translation freeing said extremity (37) of said lever (34) driven by said guidance component from said key (38), and in that an integral part (24) of said carrier (2) constitutes a stop for the extremity of said lever (34) driven by said guidance component when said lever (34) driven by said guidance component is freed from said key (38).

* * * * *